US005957287A

United States Patent [19]

Valenti et al.

[11] Patent Number: 5,957,287

[45] Date of Patent: Sep. 28, 1999

[54] ROLL STORAGE AND TRANSPORT RACK

[75] Inventors: James P. Valenti; Gilbert W. Fitzhugh, both of Lititz, Pa.

[73] Assignee: Armstrong World Industries, Inc., Lancaster, Pa.

[21] Appl. No.: 09/225,091

[22] Filed: Jan. 4, 1999

[51] Int. Cl.[6] ..... B65D 85/00

[52] U.S. Cl. ..... 206/391; 206/397; 211/60.1

[58] Field of Search ..... 206/389, 391, 206/397, 53, 54, 408, 386, 443; 211/49.1, 59.4, 60.1

[56] References Cited

U.S. PATENT DOCUMENTS

| | | | |
|---|---|---|---|
| 2,159,848 | 5/1939 | Gibbons | 410/36 |
| 2,203,199 | 6/1940 | Kelly | 410/36 |
| 2,218,316 | 10/1940 | Moon | 410/36 |
| 4,565,289 | 1/1986 | Lesueur | 206/443 |
| 4,729,537 | 3/1988 | Turner et al. | 410/36 |
| 5,099,993 | 3/1992 | Lewington et al. | 206/391 X |
| 5,287,964 | 2/1994 | Jacquand et al. | 206/391 |
| 5,294,222 | 3/1994 | Smith | 410/97 |
| 5,351,827 | 10/1994 | Baka | 410/36 |
| 5,366,086 | 11/1994 | Weerth et al. | 206/443 |
| 5,800,106 | 9/1998 | Miller | 410/96 |

*Primary Examiner*—Jacob K. Ackun

[57] ABSTRACT

The apparatus is a storage and transport rack for deformable rolled goods. One or more shelves each support a single layer of rolls. The shelves have an open input side for loading, a padded backstop opposite the input side, and unobstructed ends for unloading individual rolls with a ram pole lift truck. The upper surface of the shelves is tilted relative to the horizontal with the input side higher, so that the rolls move to the padded backstop, and a sloped ramp at the input side of the shelves starts the rolls down the shelf and assures that the rolls will not roll off the input side. For transport, the rolls are anchored by the use of straps tightened between "D" rings attached at the backstop side of the shelves and "D" rings on plugs inserted into the hollow cores of the rolls.

10 Claims, 2 Drawing Sheets

ROLL STORAGE AND TRANSPORT RACK

BACKGROUND OF THE INVENTION

This invention deals generally with storage structures and more specifically with a rack structure for multilevel storage of deformable rolls of flooring material.

Rolls of flooring material can not be stored in the same manner as rods, pipes, and other hard surface materials. Flooring material is subject to deformation, so that the contact points between layers of rolls stored one on top of another later appear as indents in the material when the material is unrolled onto a floor. This effect increases with the length of time the pressure is applied, so that a bin of rolls in which the lowest rolls would be the first in and the last out of storage, could actually damage the lowest rolls to the point where they could never be used.

This problem affects not only the long term storage of such rolls of deformable material, but also limits the transportation of such rolls. Typical prior art techniques limit the rolls on a pallet to two layers in order to limit the weight to which the lower rolls are subjected. Furthermore, the use of conventional pallets requires that each layer be composed of rolls of a single size and that each higher layer always has smaller rolls than the layer below it. An added problem is that the bands used to retain the rolls on the pallet also cause indentations at the points of contact with the rolls, so that this can also destroy the product on the rolls.

These problems are particularly troublesome in manufacturing operations which produce varying size rolls, and such operations are common because roll length is sometimes determined by the location of a fault or discontinuity in the sheet material, at which point one roll is terminated and another begun while discarding the fault. As these different size rolls come off the manufacturing line they must then be loaded onto a pallet, moved to a storage area, and transferred to a fixed storage rack. Thus, both loading onto the pallet and the transfer to the storage rack must include some means of accounting for the variations in size, and that is frequently done by a time consuming and labor intensive manual sorting process.

It would be very advantageous to have one structure to serve for both transportation and storage, and to have that structure automatically accommodate to different size rolls. Such a structure would eliminate both sorting the rolls by size and transferring the rolls between the transport pallet and the storage rack.

SUMMARY OF THE INVENTION

The present invention is a multi-shelf transportable storage rack which can be loaded automatically or manually, and from which the rolls can be removed individually. Each shelf is designed to hold a single layer of rolls which can vary in size over the entire range of the rolls normally manufactured. Each shelf is tilted slightly from the horizontal plane, so that any roll fed into the higher input side of the shelf gently rolls to the lower closed side where it is rests against a padded backstop. The input side of each shelf also includes a more steeply angled short ramp to facilitate loading and retention of the rolls on the shelf. Each shelf can easily be loaded using a gravity conveyor from the previous manufacturing stage. In many installations, the rack is located immediately following a machine which packages the rolls in paper.

The ends of the rack which are adjacent to the ends of the rolls are open, and each supporting shelf is flat at those ends.

This permits the rolls to be removed individually by the use of a ram pole lift truck. Such a truck is a conventional device for moving rolls in industry. It has a single long vertically adjustable and tiltable pole protruding horizontally out in front of it. The pole is inserted into the hollow core of a roll to lift and pull the roll off of a shelf.

The bottom of the rack is essentially flat, but is held off the floor with channel irons so that a fork lift truck can be used to move the rack, even when fully loaded with rolls. The rack can also be installed on rollers, tracks, or other transport devices in order to be adapted to automatic machinery which would move a new rack into place when a previous rack is full.

To hold the rolls on the rack without the risk of damage from tie down bands while the rack is being moved, insertable plugs are used in the ends of the hollow core of the rolls. Such plugs have serrated edges on end plates which grip into the core material when the plugs are inserted into the roll and are tilted by tension on the end opposite from the serrated end plate. A "D" ring on the end of the plug remains outside of the core. For transport, one end of a utility tie back strap is attached to each "D" ring of the two plugs inserted into both ends of the roll located nearest to the input end of the shelf. The other end of each tie back strap is similarly anchored to "D" rings permanently attached at the corners of the shelf near the bottom of the backstop. A conventional ratchet type buckle is then used to tighten each strap to retain not only the roll with the inserted plugs, but also all the rolls between that roll and the backstop.

The tie back system, along with the tilted shelves and the loading ramps makes the rack of the invention suitable not only for on site fork lift transport but also placement in trucks for over the road transport.

DETAILED DESCRIPTION OF THE INVENTION

Figure 1:
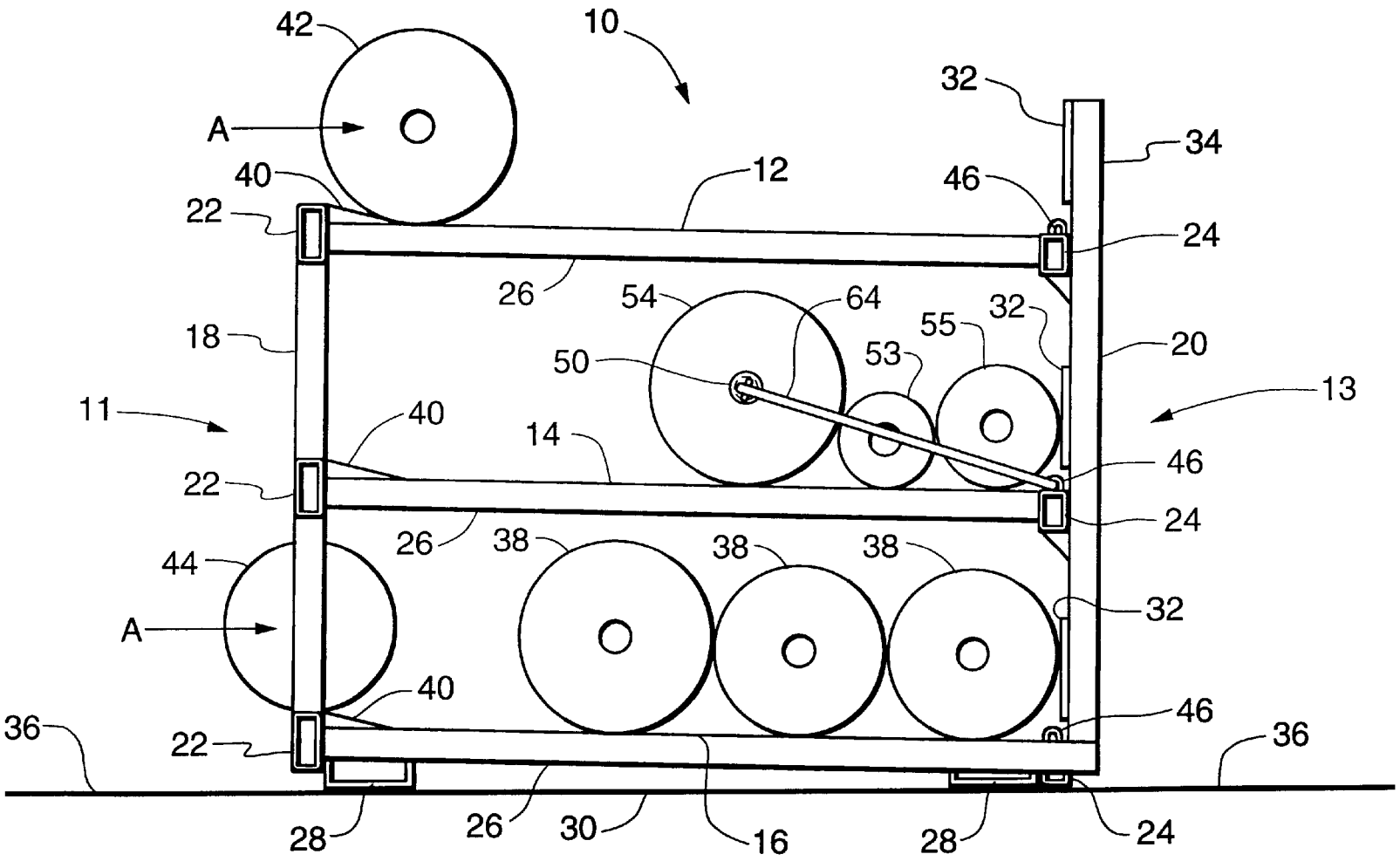
FIG. 1 is an end view of the rack of the preferred embodiment of the invention.

FIG. 1 is an end view of storage and transport rack 10 of the preferred embodiment of the invention. Rack 10 is essentially one or more shelves, with three shelves, 12, 14, and 16 shown in the embodiment of FIG. 1. The number of shelves included in rack 10 is largely determined by the load carrying ability of transport means used to move rack 10. For instance, if rack 10 is to be stationary and used only for storage, the number of shelves is only limited by the ceiling height of the building in which rack 10 is placed and the height which can be reached by the means used to load and unload rolls from rack 10. Of course, as the number of shelves and the loaded weight of rack 10 increases, the support structure for the shelves must also be strengthened according to sound engineering practice.

With only three shelves as shown in FIG. 1, the support structure for shelves 12, 14, and 16 is typically constructed of multiple box beams. Two inch by two inch box beams are used at input side 11 as vertical corner pillars 18, at backstop side 13 as vertical corner pillars 20, and as an end cross brace 26 for each shelf. A similar end cross brace is used at the other end of rack 10 (not seen in FIG. 1). Pillars 18 and 20 are located in a quadrilateral pattern, preferably a rectangle, and each of the two pillars 18 is attached to braces 22 which span the width of the shelves. Each of the two pillars 20 are attached to braces 24 which also span the width of the shelves. Horizontal four inch by two inch box beams, running perpendicular to the plane of the paper in FIG. 1, are used as input side braces 22, and horizontal three inch by two inch box beams are used for backstop side braces 24.

Two inch by two inch box beams are also used for support cross braces (not shown) along the width of the shelves. To accommodate the typical floor covering rolls which are 12 feet long, the overall width of rack 10, the dimension perpendicular to the paper of FIG. 1, is 12 feet, 9½ inches. For such a width, support cross braces running from input side 11 to backstop side 13 are located at approximately 3 foot intervals.

The base of rack 10 is constructed of inverted channels 28 running parallel to the width of rack 10 and inverted cross channels 30 running from input side 11 to backstop side 13 at intervals along the width of rack 10.

With the structure described above, the preferred embodiment of the invention attains a maximum load rating for each shelf of 2400 pounds.

Bumper pads 32 are also located at backstop side 13 of rack 10 at intervals along the width of rack 10. These bumper pads are made of sheet cushioning material and are located in a vertical plane at the end of each shelf. Bumper pads 32 are supported by 18 gauge sheet steel spanning pairs of vertical pillars 34 spaced approximately two feet apart and attached to the ends of the shelves. To accommodate to various size rolls, typically 7 to 12½ inches in diameter, the heights of bumper pads 32 above the shelves extend from 3½ inches, somewhat below the mid-height point of the smallest roll, to 6¼ inches, somewhat above the midpoint of the largest roll. In the preferred embodiment, with clearance above each shelf of 16 inches, the tops of bumper pads 32 are 9 inches above the shelves.

Shelves 12, 14, and 16 are each oriented at a slight angle to horizontal plane 36 in their span between input side 11 and backstop side 13. In the preferred embodiment this slope is only ¼ inch per foot, but it is sufficient to assure that the rolls will rest against bumper pads 32 and other rolls 38 on a shelf.

However, to facilitate loading of rolls and to assure that that the rolls will not accidentally be moved off input side 11 of the shelves, loading ramps 40 are constructed on each shelf at input end 11. Each loading ramp 40 has a slope of 15 degrees and rises to approximately 1½ inch above the shelf surface at the input side shelf edge. Loading ramp 40 provides sufficient momentum to rolls, such as rolls 42 and 44 being loaded onto shelves 12 and 16 respectively, that the rolls each move in the direction indicated by arrows A to rest against either the bumper pads or the other rolls on the shelf.

Figure 2:
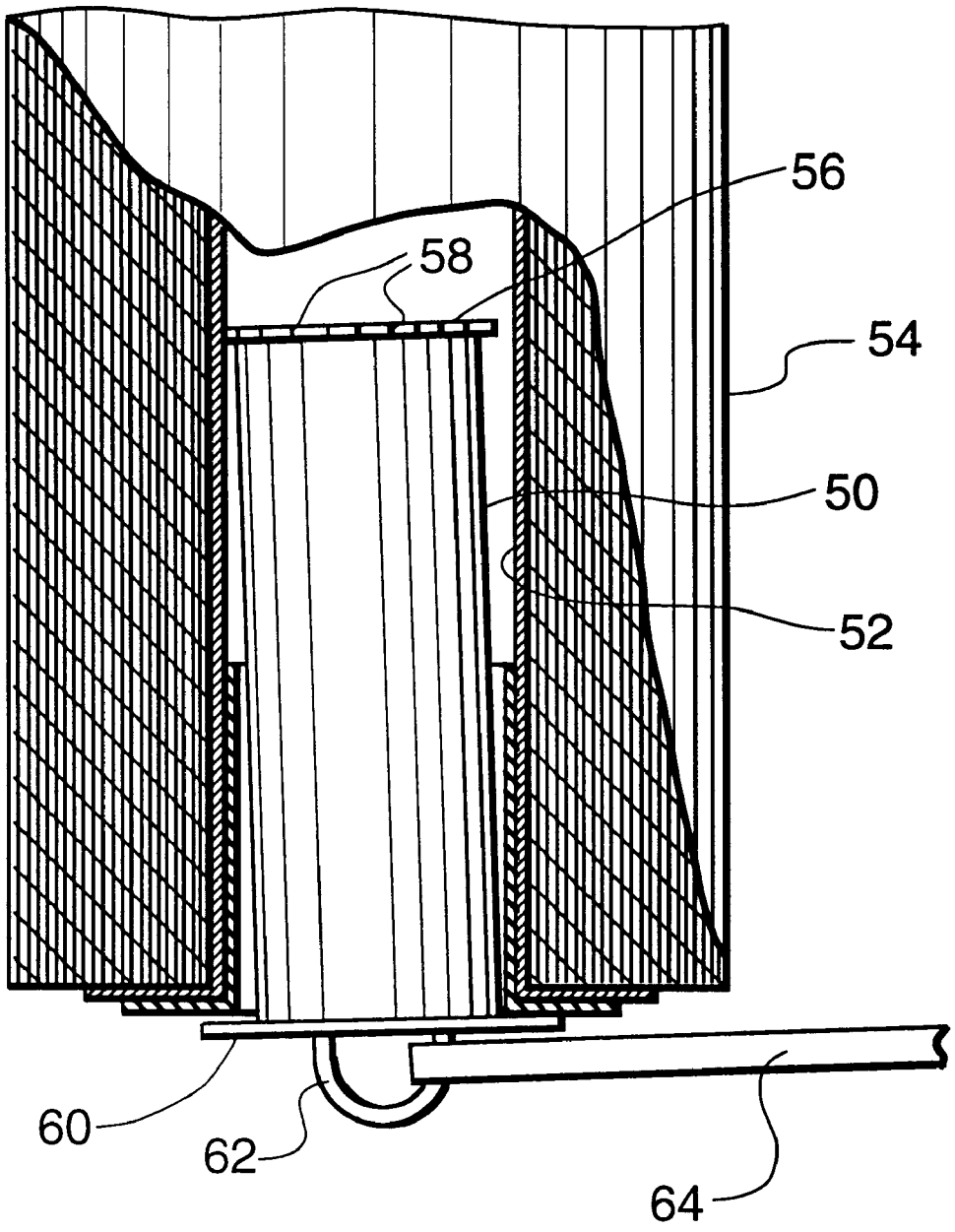
FIG. 2 is a partial cross section view of the end of a roll showing the plug inserted into the core of a roll.

To lock the rolls in place during transport, plug 50 and tie back strap 64 are used. These are shown in greater detail in FIG. 2. FIG. 2 is a partial cross section view of the end of roll 54 showing plug 50 inserted into core 52 of roll 54. Plug 50 is constructed from 3 inch outer diameter tubing with an end plate attached at each end of its 6 inch length. Inner end plate 56 is dimensioned for sliding clearance with the inner surface of core 52. In the preferred embodiment inner end plate 56 is 1/16 inch thick and is essentially a 3⅜ inch diameter circle with serrated points 58 around its circumference. Outer end plate 60 is 3/16 inch thick and is 5 inches in diameter, and ⅜ inch diameter "D" ring 62 is attached to outer end plate 60.

Strap 64 engages "D" ring 62, and the other end of strap 62 is attached to one of the similar "D" rings 46 attached to rack 10 (FIG. 1) at the corners of the various shelves adjacent to backstop side 13. Thus, when plugs 50 are inserted into both ends of core 52 of roll 54, straps 64 are attached between "D" rings 62 and 46, and straps 64 are drawn tight by conventional ratcheting strap tighteners (not shown), plug 50 tilts within core 52 and points 58 bite into core 52 to prevent plug 50 from moving. Roll 54 is thereby anchored firmly to the shelf on which it is resting. Furthermore, when roll 54 is on shelf 14 as shown in FIG. 1 and is the roll located closest to input side 11, tying back roll 54 to the shelf also traps and anchors rolls 53 and 55 which are located on the shelf between roll 54 and backstop side 13. The entire rack may then be moved, even over the road, with no danger of the rolls rolling back off input side 11 of the rack.

Plug 50 and strap 64 therefore operate to tie back rolls of material just as does conventional over-the-roll strapping. However, plug 50 can not possibly damage pressure sensitive material on the roll as does conventional strapping.

Together with the storage and transport rack of the invention, plug 50 therefore allows deformable rolled material to be safely loaded and transported without the need to transfer the rolls to permanent storage racks and without even temporary deformation of the product.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, any number of shelves may be used on rack 10, and, of course, other dimensions can be used for the shelves and other components. Furthermore, it is a simple matter to make rack 10 collapsible, foldable, or easy to disassemble so that, after racks are unloaded, multiple racks can be transported on one vehicle.

What is claimed as new and for which Letters patent of the United States are desired to be secured is:

1. A rack for holding rolled goods comprising:

a support structure comprising a base and at least first, second, third, and fourth vertical pillars attached to the base and located in a quadrilateral pattern; the first and second pillars being separated from each other and located along one side of the structure which is the input side of the support structure, with the first and second pillars each attached to at least one input side brace which spans the distance between the input side pillars, that distance being the width of the structure; and at least a third pillar and a fourth pillar being separated from each other and located along the backstop side of the structure, which is a side spaced from and opposite from the input side of the structure, with the third and fourth pillars each attached to at least one backstop side brace which spans the width of the structure; and at least one shelf covering the area between, and with its ends spanning between, an input side brace and a backstop side brace, with the shelf top surface being tilted relative to the horizontal so that its input side is higher than its backstop side.

2. The rack of claim 1 having at least one of its ends unobstructed so that rolls supported on the shelf are accessible and removeable from the ends of the shelf.

3. The rack of claim 1 further including bumper pads supported above each shelf at the backstop side of the shelf.

4. The rack of claim 1 further including bumper pads supported above each shelf at the backstop side of the shelf, the bumper pads being located in a vertical plane and dimensioned so that any size roll resting at the backstop side of the shelf will contact the bumper pad.

5. The rack of claim 1 further including a sloped loading ramp located adjacent to the input side of each shelf, with the high end of the loading ramp being at the edge of each shelf.

6. The rack of claim 1 further including anchoring means for attaching tie back straps, the anchoring means being attached adjacent to corners of the shelves at the backstop side of the shelves.

7. The rack of claim 1 further including anchoring means for attaching tie back straps, the anchoring means being "D" rings attached adjacent to corners of the shelves at the backstop side of the shelves.

8. The rack of claim 1 further including anchoring means for material rolled onto a hollow core, the anchoring means comprising "D" rings attached adjacent to corners of the shelves at the backstop side of the shelves; a core plug partially insertable into the hollow core onto which material is rolled, with the core plug including an attached "D" ring; and a tie back strap tightened between the "D" ring of the core plug and a "D" ring attached to the rack.

9. The rack of claim 8 wherein the core plug comprises: a cylinder with an inside end plate attached at the insertable end of the core plug and an outside end plate attached to the end of the core plug which remains outside the hollow core; the inside end plate is dimensioned to have sliding clearance with the inside of the core into which it is inserted and is constructed with serrated points on its edges; and the outside end plate is dimensioned to prevent its insertion into the core and has a "D" ring attached to it.

10. A means for holding down material rolled onto a hollow core comprising a core plug which is partially insertable into the hollow core, the core plug comprising: a cylinder with an inside end plate attached at the insertable end of the core plug and an outside end plate attached to the end of the core plug which remains outside the hollow core; the inside end plate is dimensioned to have sliding clearance with the inside of the core into which it is inserted and is constructed with serrated points on its edges; and the outside end plate is dimensioned to prevent its insertion into the core and has a "D" ring attached to it.

* * * * *